US008136884B2

(12) United States Patent
Bullard et al.

(10) Patent No.: US 8,136,884 B2
(45) Date of Patent: Mar. 20, 2012

(54) TEXTILE-ATTACHED DECK ASSEMBLY

(75) Inventors: Larry I. Bullard, Winston-Salem, NC (US); William J. Distler, Lexington, NC (US)

(73) Assignee: L & P Property Management Company, South Gate, CA (US)

( * ) Notice: Subject to any disclaimer, the term of this patent is extended or adjusted under 35 U.S.C. 154(b) by 84 days.

(21) Appl. No.: 12/700,205

(22) Filed: Feb. 4, 2010

(65) Prior Publication Data

US 2010/0194172 A1 Aug. 5, 2010

Related U.S. Application Data

(60) Provisional application No. 61/149,938, filed on Feb. 4, 2009.

(51) Int. Cl.
*A47C 7/02* (2006.01)

(52) U.S. Cl. ..... 297/452.52; 297/452.49; 297/452.53; 297/452.54; 297/452.55; 297/452.56; 267/110

(58) Field of Classification Search ..... 297/452.49, 297/452.52–452.57; 5/228, 230, 233, 247; 267/81, 91, 95–97, 100, 110, 111, 142, 143
See application file for complete search history.

(56) References Cited

U.S. PATENT DOCUMENTS

| | | | | | |
|---|---|---|---|---|---|
| 71,352 | A * | 11/1867 | Wilson | 5/239 |
| 975,358 | A | 11/1910 | Hefter | |
| 1,765,795 | A * | 6/1930 | Kessler | 139/425 R |
| 2,052,811 | A | 9/1936 | Suekoff | |
| 2,085,475 | A * | 6/1937 | Saives | 297/452.56 |
| 2,341,419 | A * | 2/1944 | Bank | 267/102 |
| 3,037,766 | A * | 6/1962 | Berg | 267/110 |
| 3,137,490 | A * | 6/1964 | Reed | 267/110 |
| 3,245,091 | A * | 4/1966 | Spitz | 5/51.1 |
| 3,384,148 | A | 5/1968 | Sarginson | |
| 3,497,883 | A * | 3/1970 | Arnold et al. | 5/188 |
| 3,610,688 | A * | 10/1971 | Arnold et al. | 297/452.49 |
| 3,695,706 | A * | 10/1972 | Basher et al. | 297/452.56 |
| 3,902,756 | A * | 9/1975 | Chubb | 297/452.56 |
| 3,972,079 | A | 8/1976 | Shellow | |
| 4,136,410 | A * | 1/1979 | Vandenbark et al. | 5/190 |
| 4,285,080 | A * | 8/1981 | Kitchen et al. | 5/186.1 |
| 4,842,257 | A * | 6/1989 | Abu-Isa et al. | 267/133 |
| 4,883,320 | A * | 11/1989 | Izumida et al. | 297/452.56 |
| 4,928,334 | A * | 5/1990 | Kita | 5/191 |
| 5,624,161 | A * | 4/1997 | Sorimachi et al. | 297/452.52 |
| 6,070,942 | A * | 6/2000 | Barton et al. | 297/452.41 |
| 6,116,694 | A | 9/2000 | Bullard | |
| 6,478,381 | B1 * | 11/2002 | Cramb et al. | 297/452.13 |
| 6,676,218 | B2 * | 1/2004 | Fujita et al. | 297/452.49 |

FOREIGN PATENT DOCUMENTS

GB 2028120 A * 3/1980

* cited by examiner

*Primary Examiner* — Laurie Cranmer
(74) *Attorney, Agent, or Firm* — Shook, Hardy & Bacon L.L.P.

(57) ABSTRACT

A seating product comprising a seat deck assembly secured at opposite ends to a frame. The seat deck assembly comprises a seat deck. A textile border is disposed between at least one end of the seat deck assembly and the frame. The textile border is attached to the frame, thereby flexibly coupling the seat deck assembly thereto. Cushions, padding or an upholstered covering can complete embodiments of the seating product.

15 Claims, 5 Drawing Sheets

TEXTILE-ATTACHED DECK ASSEMBLY

CROSS-REFERENCE TO RELATED APPLICATIONS

This application claims the benefit of U.S. provisional patent application No. 61/149,938, filed Feb. 4, 2009, titled "Textile-Attached Seating System."

BACKGROUND

Seating support structures that include wire grid products in the seat deck assembly are known. Currently, a typical wire grid product is suspended between the frame rails by stapling one border wire to the front rail with narrow crown staples. Wire or sheet metal hangers are then attached to the rear rail and tight wound helical extension springs are stretched between the rear border wire of the grid and the installed rear hangers. Although the wire grid product generally provides a comfortable seating surface initially, the nature of its installation is often problematic.

While helical springs generally provide for comfortable support when used to attach the rear of a wire grid seating assembly to a frame, they often lose their tension over time. Due to the mechanical nature of tight wound helical springs, exposure to heavy loads eventually decreases the tension in the springs. This tension cannot be retrieved without purchasing and installing a new set of springs. Accordingly, it is desirable to introduce a seating deck assembly that can be attached to a frame that provides comparable support and comfort while guaranteeing a longer useful life. A deck assembly that can handle extremely heavy loads without losing any mechanical integrity is also desired.

Current installation designs also increase the potential for weaker structures. Because the front side of wire grid assemblies are typically stapled, at a border wire, directly to the frame, the cross wires can sometimes break. If the front border wire is attached even slightly too far forward, the cross wires will make undesirable contact with the frame. Then, as the grid goes up and down in response to people sitting on, shifting on, and getting up from the seat, the wires flex on the board. This flex can be severe enough to break the wires, which compromises the integrity of the entire seating product. It is thus desirable to introduce a product that avoids this inherent risk by being easier to install with less precision, and preferably, by avoiding any contact between cross wires and the frame.

Current grid seating systems may also be quite noisy. Helical springs are generally attached using metal hangers. Movement on the seating product causes the helical springs to rotate and shift about their coupling with the hangers. The helical springs also generally are attached directly to the wires of the wire grid assembly, and this coupling may shift when the grid assembly moves. This metal on metal movement often causes an audible squeak that may get worse over time. Additionally, the cross wires may make unpleasant noise as they shift against the wood of the frame at the front attachment. Therefore, it is further desirable to have a deck assembly that attaches to a seating product frame in such a way that movement of the deck assembly is noise free.

Therefore, it has been one objective of the present invention to provide a seating product which does not require the use of helical springs in order to secure the ends of a deck assembly to the frame of the seating product.

It has further been an objective of the present invention to provide a seating product which does not require directly stapling a border wire of a wire grid assembly to the frame of the seating product to attach the deck assembly thereto.

It has been a further objective of the present invention to provide a seating product in which movement of a deck assembly in response to a user's movement does not create unnecessary noise.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present inventions relate to a seating product that includes a frame comprised of a front rail, a rear rail, and a pair of opposed side rails. The seating product further includes a deck assembly, flexibly coupled to the rear rail and extending between the rear rail and the front rail. The deck assembly may have a textile border coupled thereto and disposed between the deck assembly and the front rail of the frame, thereby flexibly coupling a front side of the deck assembly to the front rail of the frame. In one embodiment, the rear side of the deck assembly may be coupled to the rear rail of the frame by disposing a non-elastic or elastomeric textile border between the deck assembly and the rear rail of the frame. In one embodiment, the deck assembly may include a wire grid assembly and the seating product may further have a padding layer located over the wire grid assembly and a covering disposed over the padding layer. In another embodiment, the decking assembly may include a fabric deck such that a seat cushion can be placed directly on the fabric deck.

Further embodiments of the present inventions provide for a seating product comprising a frame, a deck assembly and at least one textile border coupled to the deck assembly and disposed between the deck assembly and the frame. The deck assembly may comprise a wire grid assembly or a fabric seat deck. The wire grid assembly may comprise a plurality of spaced spring wires secured to border wires along each of two spaced ends of the spring wires. The fabric seat deck may comprise a piece of woven or non-woven fabric such as, for example, woven polypropylene or nylon.

According to embodiments of the inventions a deck assembly for use as a seating support structure may comprise a wire grid assembly including a plurality of spaced spring wires arranged having spaced, parallel terminal ends. The wire grid assembly may further include a woven elastomeric fabric coupled to the spaced spring wires along one terminal end and a non-elastic fabric coupled to the spaced spring wires along the other terminal end.

According to other embodiments of the inventions, a deck assembly for use as a seating support structure may comprise a fabric seat deck including a piece of woven, non-elastic fabric disposed between the front and rear rails and the side rails of the frame. The fabric seat deck may further include a woven elastomeric fabric coupled to the fabric seat deck along one edge and a non-elastic fabric coupled to the fabric seat deck along an opposite edge.

According to further embodiments of the inventions, a deck assembly for use as a seating support structure may comprise a fabric seat deck disposed between the rails of a rectangular frame. The fabric seat deck may be coupled along one edge to an elastomeric fabric, which is coupled to a rail of the frame. The fabric seat deck may be coupled along the opposite edge to a non-elastic fabric, which is coupled to an opposite rail of the frame. In other embodiments, the fabric seat deck may be coupled along one edge directly to the frame.

According to embodiments of the inventions, a deck assembly for use in a seating support structure may comprise a fabric seat deck disposed between the rails of a frame. The fabric seat deck may be coupled along one edge to an elastomeric fabric, which may be coupled to a rail of the frame. The elastomeric fabric may comprise a webbing that stretches laterally, rather than longitudinally.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

Figure 1:
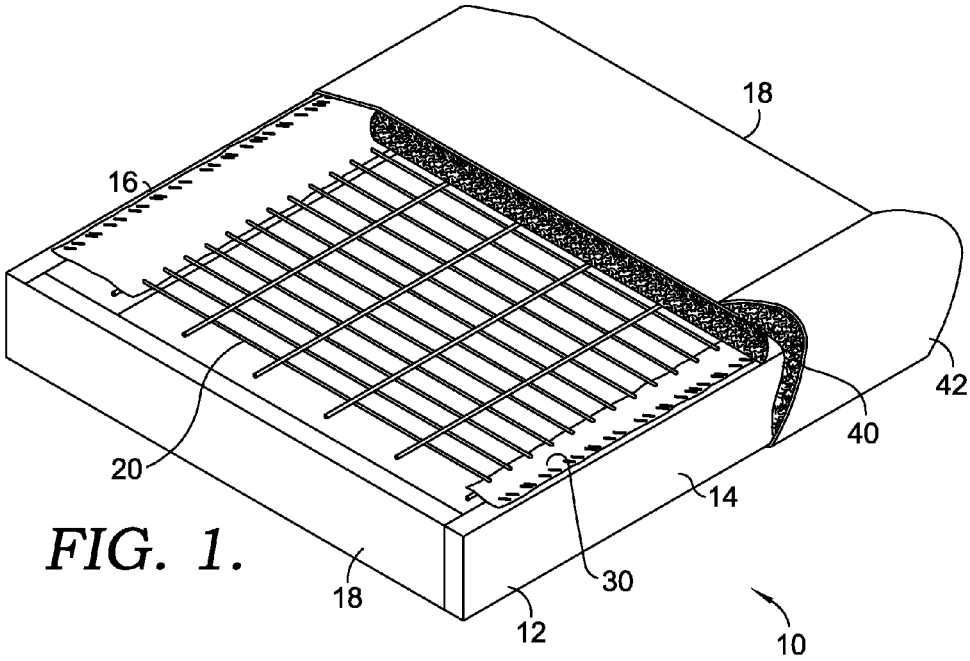
FIG. 1 is a perspective view partially cut away of a seating product in accordance with an embodiment of the present invention.

Referring to the drawings, and particularly to FIG. 1, there is illustrated a seating product 10. The seating product 10 may be, for example, a seat section or a back section of a chair, sofa, love seat, sectional, or any other component of furniture. The seating product 10 comprises a frame 12 and deck assembly 20 secured to the frame. The deck assembly can include a wire grid assembly 20 (as illustrated in the embodiment depicted in FIG. 1) or a fabric deck. One or more layers of padding 40 may cover one or more surfaces of the seating product. A covering 42 may be disposed over the padding 40.

As illustrated in FIG. 1, the frame 12 comprises a front rail 14, a rear rail 16 and a pair of opposed side rails 18. The front and rear rails 14, 16 comprise a pair of opposed rails. The frame 12 may be constructed by any material known and used in the art, but is typically constructed from wood. The size of the frame 12 will vary depending on the application, and may be adapted for use, for example, as a seat section or a seat back of a piece of furniture.

A wire grid assembly 20 is illustrated in FIG. 1 as extending between the front rail 14 and the rear rail 16 of the frame 12. The wire grid assembly may be any such assembly known and used in the art, and the construction of the assembly is not limited by the description herein. For example, in one embodiment, the wire grid assembly may be an assembly such as the Perma-Eze™ or Perma-Eze-Plus™ Grid Construction as manufactured and sold by the Flex-O-Lators division of Leggett & Platt®, Incorporated. In such an embodiment, the wire grid assembly includes 1" spaced 18 gauge oil-tempered spring wires which pierce HDPE tubing center cords. The spring wires are "lock-knotted" around 12 gauge oil-tempered border wires. The border wires may be covered with kraft-paper, plastic, or any other appropriate material.

Figure 2:
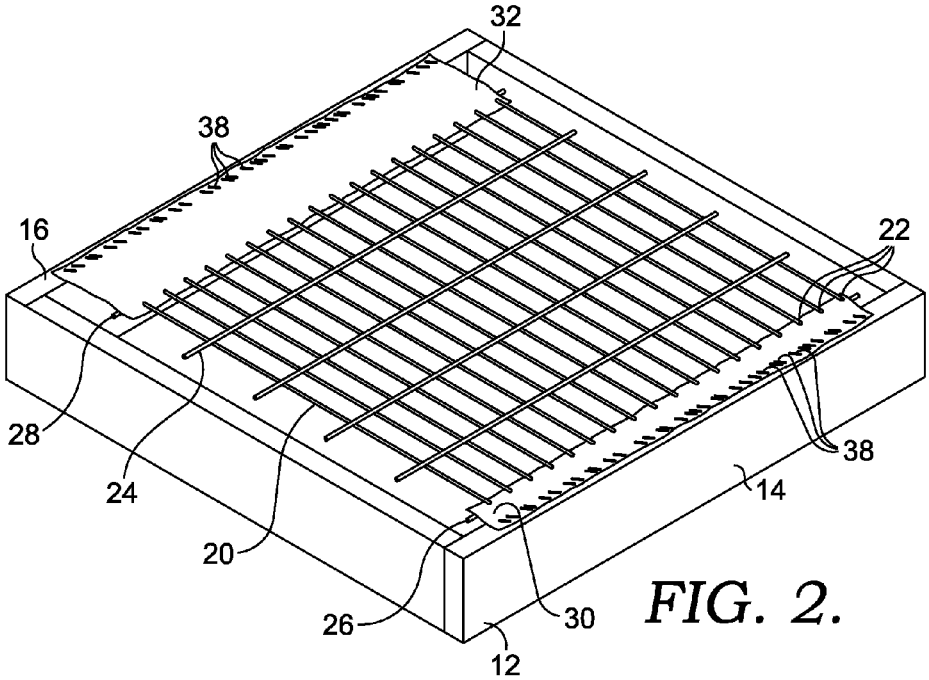
FIG. 2 is a perspective view of a seating product in accordance with an embodiment of the present invention.

In another embodiment, as illustrated in FIG. 2, the wire grid assembly 20 comprises a plurality of spaced spring wires 22, which are secured at each end to a pair of border wires 26, 28 which are arranged perpendicularly to the spring wires. The spring wires 22 are held in place with one or more center cords 24. The spring wires 22 may pierce the center cords 24 or may be coupled to the center cords 24 in any other manner known in the art. In one embodiment, the spring wires may have a plastic coating that helps protect them from wear. In other embodiments, the spring wires may be coated with a different material or left uncoated.

The wire grid assembly 20 extends between the front rail 14 of the frame 12 and the rear rail 16 of the frame 12. A front end of the wire grid assembly 20 is coupled to the front rail 14 of the frame 12. As shown in FIG. 1 and FIG. 2, this coupling may be achieved by disposing a textile border 30 between the wire grid assembly and the front rail 14 of the frame 12. This textile border 30 may be made of elastomeric fabric or non-elastic fabric. The textile border may be secured to the wire grid assembly 20 by weaving the border into the wire grid assembly during manufacture. In other embodiments, the textile border may be secured to the wire grid assembly by any number of other methods. In an embodiment, the textile border may be further secured to the frame 12 with standard upholstery staples 38, as shown in FIG. 2.

As shown in FIG. 2, the wire grid assembly 20 may be flexibly coupled to the rear rail 16 of the frame 12. The flexible coupling may be achieved, for example, by disposing a second textile border 32 between the wire grid assembly, adjacent to border wire 28, and the rear rail 16 of the frame 12. As with the first textile border 30 described above, the second textile border 32 may be made of elastomeric fabric or non-elastic fabric. For example, the textile border of the present invention may be made of any number of woven or nonwoven fabric materials. One such type of webbing material is a polyester material trademarked "SYTEX®", manufactured by the MATREX® division of Leggett & Platt, Incorporated. A second alternative type of webbing material suitable for making a textile border used in the present invention is a woven polypropylene material containing rubber or elastomeric filaments. Another alternative type of webbing material suitable for making a textile border used in the present invention is a laterally-stretchable warp knit fabric such as, for example, the laterally-stretchable fabric described in U.S. application Ser. No. 12/700,336, filed Feb. 4, 2010, and entitled "Laterally-Stretchable Knit Fabric," the entirety of which is incorporated herein by reference. However, these are just three examples of any number of materials that may be used for the textile border in the present invention.

In one embodiment, the second textile border 32 comprises an elastomeric fabric, thereby providing a comfortable seating platform. The second textile border 32, like the first textile border 30, may be fastened to the rear rail 16 of the frame 12 in any number of ways known in the art. As shown in FIG. 2, for example, the second textile border 32 may be fastened to the rear rail 16 of the frame with standard upholstery staples 38. In one embodiment, the textile border 32 may be stretched before attachment to the rear rail 16 by utilizing a hand tool. In another embodiment, a machine may be used to stretch the textile border 32 before attaching it to the rear rail 16.

Figure 3:
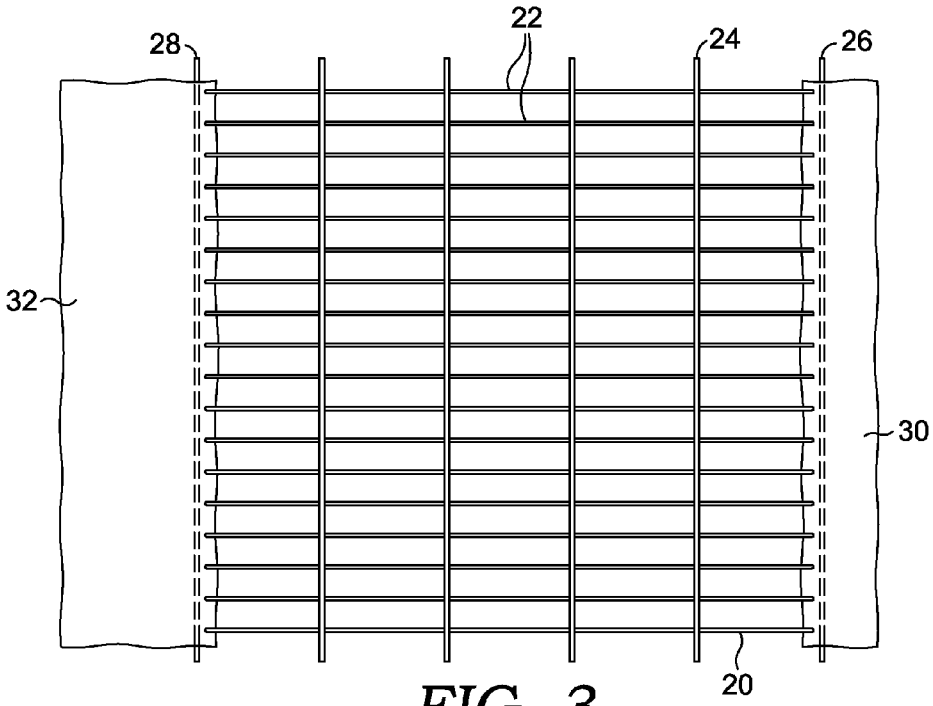
FIG. 3 is a top plan view of a portion of the seating product of FIG. 1 in accordance with an embodiment of the present invention.
Figure 5:
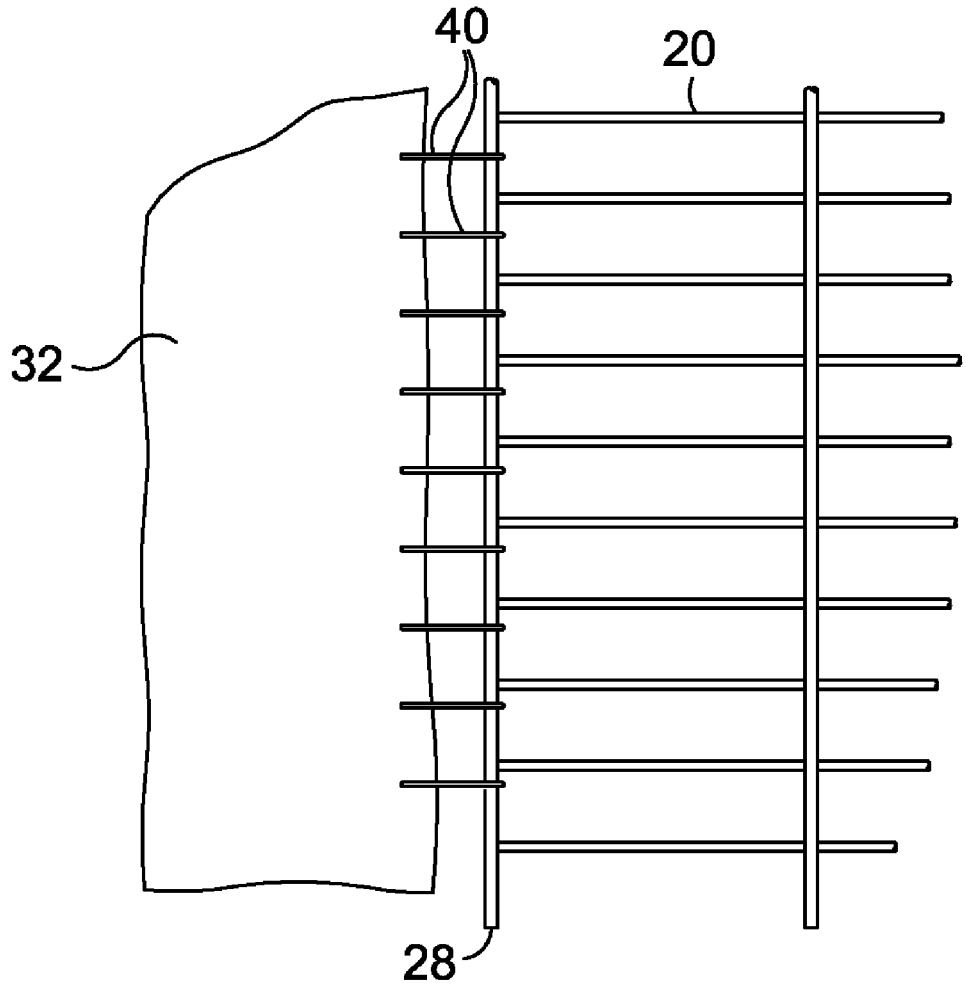
FIG. 5 is a top plan view of a portion of the seating product of FIG. 3 in accordance with an embodiment of the present invention.

Turning now to FIG. 3, there is illustrated a top plan view of a portion of the seating product illustrated in FIG. 1 and FIG. 2. More specifically, FIG. 3 illustrates a top plan view of a wire grid assembly 20 having a first textile border 30 attached to a front side of the wire grid assembly 20 and disposed adjacent to a border wire 26. In one embodiment, as illustrated in FIG. 3, the first textile border 30 may comprise a non-elastic fabric and may be woven into the wire grid assembly 20 during manufacture. The wire grid assembly 20 illustrated in FIG. 3 further includes a second textile border 32 attached to a rear side of the wire grid assembly 20 and adjacent to a border wire 28. The second textile border 32 may comprise an elastomeric fabric and may be woven into the wire grid assembly 20 along the terminal ends of the spaced spring wires 22 on a rear side of the assembly in a manner similar to that discussed above. For example, in an embodiment, the second textile border 32 can comprise a laterally-stretchable fabric such as the fabric described in U.S. application Ser. No. 12/700,336. In an embodiment, as illustrated in FIG. 5, the second textile border 32 may be secured to the wire grid assembly 20 by one or more metal fasteners 40 disposed between the textile border 32 and the wire grid assembly 20. Similarly, the first textile border 30 can be attached to the wire grid assembly 20 in the manner described in FIG. 5 or in any other suitable manner.

The wire grid assembly 20 includes a plurality of spaced spring wires 22 that are held in place by a plurality of center cords 24. On a front side of the wire grid assembly, the spaced terminal ends of the spaced spring wires 22 are woven into the first textile border 30 such that the spaced spring wires 22 pierce the textile border 30. The spaced spring wires 22 may be secured to the border wire 26 by wrapping each spaced spring wire 22 around the border wire 26 and knotting the spaced spring wire 22.

Figure 4:
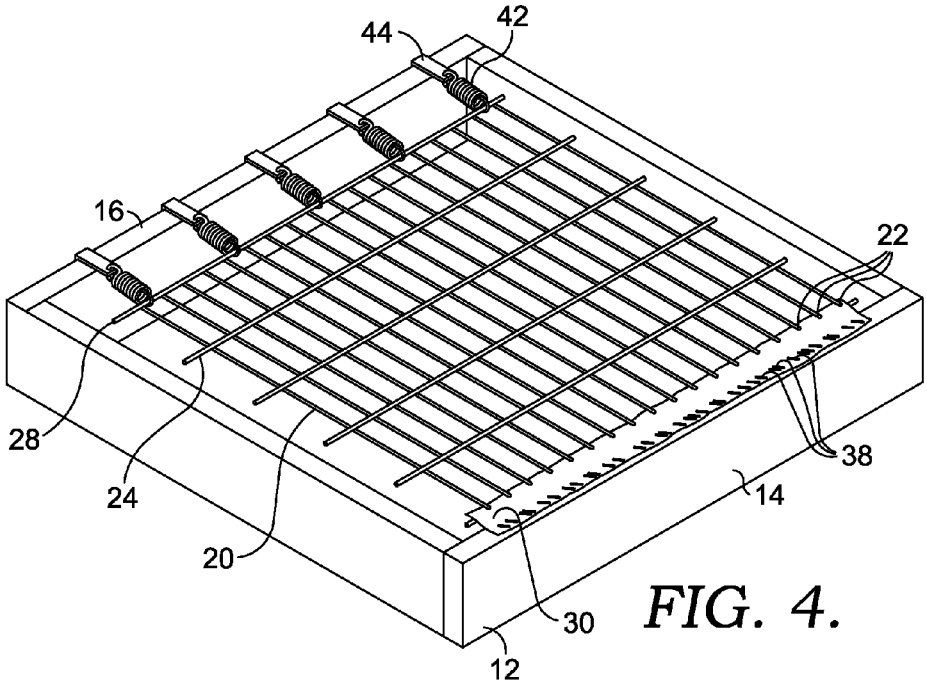
FIG. 4 is a perspective view of a seating product in accordance with an embodiment of the present invention.

An embodiment of the present invention, as illustrated in FIG. 4, may have a wire grid assembly 20 disposed between a front 14 and rear rail 16 of a frame 12, wherein a front side of the wire grid assembly 20 is flexibly coupled to the frame 12 by disposing a non-elastic textile fabric 30 between the front rail 14 of the frame 12 and the wire grid assembly 20. The wire grid assembly 20 may further be flexibly coupled to the rear rail 16 of the frame 12 by disposing a plurality of helical springs 42 between the wire grid assembly 20 and the rear rail 16 of the frame 12. Each of the helical springs 42 may be secured to a border wire 28 of the wire grid assembly 20 at one end of the helical spring 42 and attached to a metal hangar 44 that is secured to the rear rail 16 of the frame 12 at an opposite end of the helical spring 42.

Figure 6:
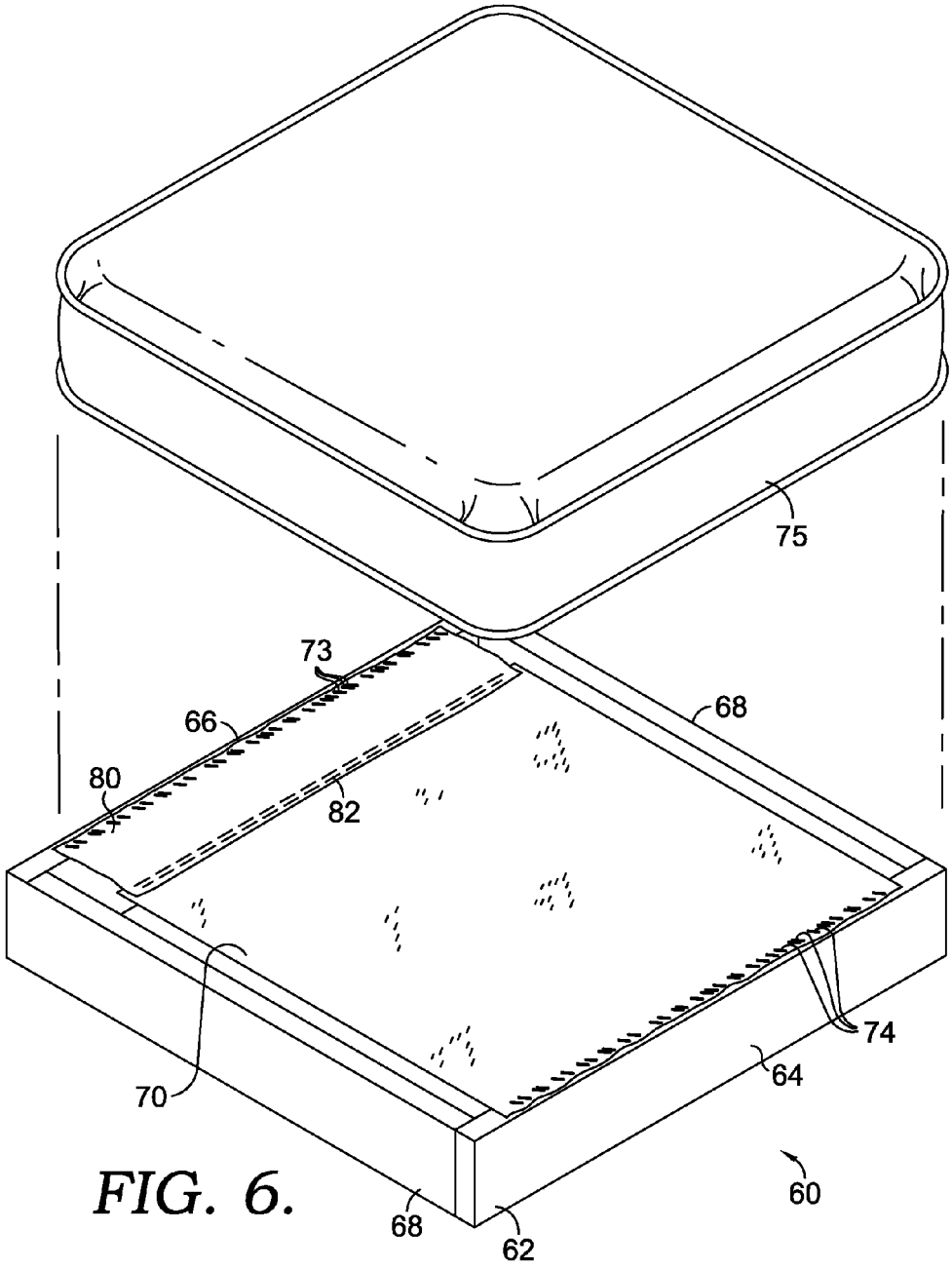
FIG. 6 is a perspective view of a seating product in accordance with an embodiment of the present invention.

Turning now to FIG. 6, there is illustrated a seating product 60, in accordance with other embodiments of the inventions. The seating product 60 may be, for example, a seat section or a back section of a chair, sofa, love seat, sectional, or any other component of furniture. The seating product 60 comprises a frame 62 and a fabric seat deck 70 secured to the frame. According to some embodiments, the fabric seat deck 70 can be a single piece of strong fabric such as, for example, woven polypropylene fabric, woven nylon fabric, and the like. As depicted in FIG. 6, a cushion 75 can simply be positioned atop the fabric seat deck 70 as shown. In other embodiments, the fabric seat deck 70 itself can serve as the primary seating surface and can be covered in various materials, coated, finished, and the like, for any number of aesthetic appearances.

As illustrated in FIG. 6, the frame 62 comprises a front rail 64, a rear rail 66 and a pair of opposed side rails 68. The front and rear rails 64, 66 comprise a pair of opposed rails. The frame 62 may be constructed by any material known and used in the art, but is typically constructed from wood. The size of the frame 62 will vary depending on the application, and may be adapted for use, for example, as a seat section or a seat back of a piece of furniture.

A fabric deck 70 is illustrated in FIG. 6 as extending between the front rail 64 and the rear rail 66 of the frame 62. The fabric deck 70 may include any number of types of fabric. In some embodiments, the fabric deck 70 is a single piece of fabric, and in other embodiments, fabric deck 70 includes a number of pieces of fabric. Different types of fabric can provide different aesthetics and functionality. For example, according to an embodiment, fabric deck 70 comprises a single piece of woven polypropylene, which is a strong and affordable fabric. According to other embodiments, fabric deck 70 can comprise woven nylon, a more expensive fabric, if greater strength and/or aesthetic appeal is desired.

The fabric deck 70 extends between the front rail 64 of the frame 62 and the rear rail 66 of the frame 62. A front end of the fabric deck 70 is coupled to the front rail 64 of the frame 62. As shown in FIG. 6, the fabric deck 70 can be coupled directly to front rail 64 of the frame. For example, in an embodiment, fabric deck 70 can be secured to the frame 62 using standard upholstery staples 74.

Figure 7:
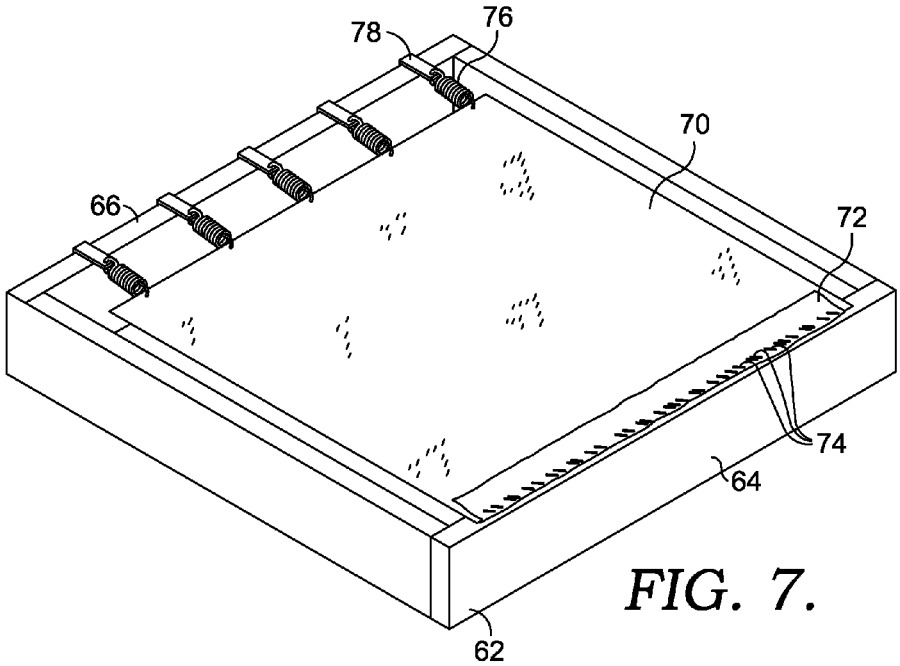
FIG. 7 is a perspective view of a seating product in accordance with an embodiment of the present invention.

Turning briefly to FIG. 7, embodiments of the inventions include embodiments in which this coupling is achieved by disposing a textile border 72 between the fabric deck 70 and the front rail 64 of the frame 62. This textile border 72 may be made of elastomeric fabric or non-elastic fabric. The textile border may be secured to the fabric deck 70, for example by weaving the border into the fabric deck 70 during manufacture. In other embodiments, the textile border 72 may be secured to the fabric deck 70 by any number of other methods. For example, textile border 72 can be sewn to fabric deck 70 using a series of stitches. The textile border 72 may be further secured to the frame 62 with standard upholstery staples 74, as shown in FIG. 7.

Returning to FIG. 6, the fabric deck 70 may be flexibly coupled to the rear rail 66 of the frame 62. The flexible coupling may be achieved, for example, by disposing a second textile border 80 between the fabric deck 70 and the rear rail 66 of the frame 62. As with the first textile border 72 described above with reference to FIG. 7, the second textile border 80 may be made of elastomeric fabric or non-elastic fabric. For example, the textile border of the present invention may be made of any number of woven or nonwoven fabric materials. One such type of webbing material is a polyester material trademarked "SYTEX®", manufactured by the MATREX® division of Leggett & Platt, Incorporated. A second alternative type of webbing material suitable for making a textile border used in the present invention is a woven polypropylene material containing rubber or elastomeric filaments. In other embodiments, the textile border 80 can be a length of a laterally-stretchable warp knit fabric, as described in U.S. application Ser. No. 12/700,336.

With reference to FIG. 7, a seating product according to embodiments of the invention may have a fabric seat deck 70 disposed between a front 64 and rear rail 66 of a frame 62, wherein a front side of the fabric seat deck 70 is flexibly coupled to the frame 62 by disposing a non-elastic textile fabric 72 between the front rail 64 of the frame 62 and the fabric seat deck 70. The fabric seat deck 70 may further be flexibly coupled to the rear rail 66 of the frame 62 by disposing a plurality of helical springs 76 between the fabric seat deck 70 and the rear rail 66 of the frame 62. Each of the helical springs 76 may be secured to the fabric seat deck 70 at one end of the helical spring 76 and attached to a metal hangar 78 that is secured to the rear rail 66 of the frame 62 at an opposite end of the helical spring 76.

Figure 8:
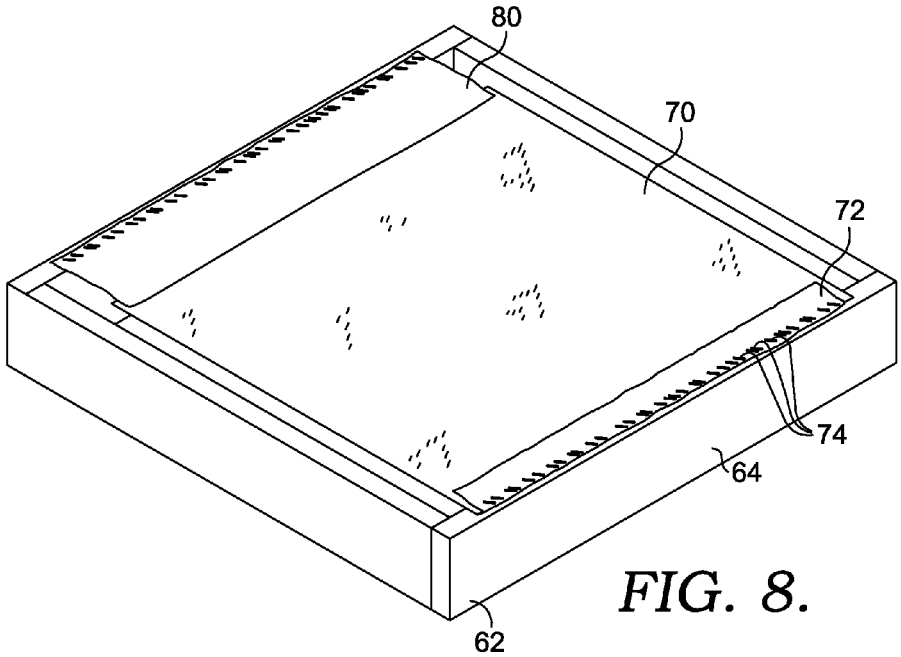
FIG. 8 is a perspective view of a seating product in accordance with an embodiment of the present invention.

With reference to FIG. 8, a fabric seat deck 70 is illustrated as extending between the front rail 64 and the rear rail 66 of the frame 62. A front end of the fabric deck 70 is coupled to the front rail 64 of the frame 62. As shown in FIG. 7, embodiments of the inventions include embodiments in which this coupling is achieved by disposing a textile border 72 between the fabric deck 70 and the front rail 64 of the frame 62. This textile border 72 may be made of elastomeric fabric or non-elastic fabric. The textile border may be secured to the fabric deck 70, for example by weaving the border into the fabric deck 70 during manufacture. In other embodiments, the textile border 72 may be secured to the fabric deck 70 by any number of other methods. For example, textile border 72 can be sewn to fabric deck 70 using a series of stitches. The textile border 72 may be further secured to the frame 62 with standard upholstery staples 74, as shown in FIG. 8.

With continued reference to FIG. 8, the fabric deck 70 may be flexibly coupled to the rear rail 66 of the frame 62. The flexible coupling may be achieved, for example, by disposing a second textile border 80 between the fabric deck 70 and the rear rail 66 of the frame 62. As with the first textile border 72 described above with reference to FIG. 7, the second textile border 80 may be made of elastomeric fabric or non-elastic fabric. For example, in some embodiments, the textile border 80 can be a length of a laterally-stretchable warp knit fabric, as described in U.S. application Ser. No. 12/700,336.

Some embodiments of the inventions are directed toward a seating product having a fabric seat deck disposed between a front and rear rail of a frame, wherein the front side of the fabric seat deck is attached to the frame by securing an edge of the fabric directly to the front rail of the frame. Additionally, further embodiments of the present invention relate to attaching a front side of a fabric seat deck to a front rail of a frame by disposing metal hangars between the fabric seat deck and the front rail of the frame and attaching a rear side of the fabric seat deck to the frame by disposing a textile border, which may be non-elastic or elastomeric, between the fabric seat deck and the rear rail of the frame.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. A seating product comprising:

a frame comprising a front rail, a rear rail and a pair of opposed side rails, a deck assembly comprising a wire grid assembly flexibly coupled to the rear rail of the frame and extending between the front rail and the rear rail, at least one first textile border coupled to the deck assembly by weaving the first textile border into the wire grid assembly, the first textile border extending between the deck assembly and the front rail of the frame, thereby coupling a front side of the deck assembly to the front rail of the frame, a padding layer located over said deck assembly, and a covering disposed over said padding layer.

2. The seating product of claim 1, wherein the deck assembly includes a fabric deck.

3. The seating product of claim 1, wherein the at least one first textile border comprises an elastomeric fabric.

4. The seating product of claim 1, comprising a second textile border coupled to the deck assembly and extending between the deck assembly and the rear rail of the frame, thereby flexibly coupling a rear side of the deck assembly to the rear rail of the frame.

5. The seating product of claim 4, wherein the second textile border comprises an elastomeric fabric.

6. The seating product of claim 5, wherein a plurality of metal fasteners is disposed between the second textile border and the deck assembly, the fasteners being coupled on one side to the deck assembly and the fasteners being coupled on an opposite side to the textile border, thereby flexibly coupling the textile border to the deck assembly.

7. The seating product of claim 1, wherein the wire grid assembly comprises a plurality of spaced spring wires held in place with one or more center cords.

8. The seating product of claim 7, wherein the wire grid assembly further comprises a pair of border wires disposed respectively adjacent to the front and rear sides of the frame.

9. A seating product comprising:

a frame, a wire grid assembly, comprising a plurality of spaced spring wires secured to border wires along each of two spaced ends of the spring wires, and at least one textile border coupled to the wire grid assembly adjacent to at least one of the border wires, the wire grid assembly being secured on one edge to said frame by securing the at least one textile border to said frame, wherein the at least one textile border is coupled to the wire grid assembly by weaving the textile border into the wire grid assembly.

10. The seating product of claim 9, wherein the wire grid assembly further comprises a plurality of spaced center cords arranged perpendicular to the spaced spring wires, and having spaced, parallel terminal ends.

11. The seating product of claim 10, wherein the spaced spring wires are coupled to the spaced center cords to hold the spring wires in place.

12. The seating product of claim 9, wherein the at least one textile border comprises an elastomeric fabric.

13. A seating product comprising:

a frame, a fabric deck, and at least one textile border coupled to the fabric deck, the fabric deck being secured on a first edge to said frame by securing the at least one textile border to said frame, wherein the at least one textile border is secured to the first edge of the fabric deck by weaving the textile border into the fabric deck during manufacture.

14. The seating product of claim 13, further comprising a second textile border coupled to a second edge of the fabric deck and extending between the fabric deck and the frame, thereby flexibly coupling the fabric deck on a second edge to the frame.

15. The seating product of claim 14, wherein the second textile border is elastomeric.

* * * * *